US011107454B2

(12) United States Patent
Volmer et al.

(10) Patent No.: US 11,107,454 B2
(45) Date of Patent: Aug. 31, 2021

(54) DEVICE, SYSTEM AND PROCESS FOR AUDIO SIGNAL PROCESSING

(71) Applicant: Dräger Safety AG & Co. KGaA, Lübeck (DE)

(72) Inventors: Achim Volmer, Krummesse (DE); Michael Brodersen, Klein Wesenberg (DE); Jens Reermann, Achim (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 0 days.

(21) Appl. No.: 16/820,330

(22) Filed: Mar. 16, 2020

(65) Prior Publication Data

US 2020/0302909 A1 Sep. 24, 2020

(30) Foreign Application Priority Data

Mar. 21, 2019 (DE) ..... 10 2019 001 966.0

(51) Int. Cl.

| | |
|---|---|
| ***G10K 11/178*** | (2006.01) |
| ***H04R 1/08*** | (2006.01) |
| ***H04R 1/10*** | (2006.01) |
| ***H04R 3/00*** | (2006.01) |
| ***H04R 3/12*** | (2006.01) |
| ***A62B 18/08*** | (2006.01) |
| ***A42B 3/30*** | (2006.01) |

(52) U.S. Cl.

CPC .. *G10K 11/17881* (2018.01); *G10K 2210/509* (2013.01); *H04R 2460/01* (2013.01)

(58) Field of Classification Search

None

See application file for complete search history.

(56) References Cited

U.S. PATENT DOCUMENTS

| | | | | |
|---|---|---|---|---|
| 8,229,740 | B2 | 7/2012 | Nordholm et al. | |
| 2012/0215519 | A1* | 8/2012 | Park | G10L 21/0208 704/2 |
| 2014/0081631 | A1* | 3/2014 | Zhu | G10L 21/0208 704/226 |
| 2015/0003625 | A1 | 1/2015 | Uhle et al. | |
| 2018/0025718 | A1* | 1/2018 | Zukowski | G10K 11/17881 381/71.6 |

(Continued)

FOREIGN PATENT DOCUMENTS

DE 112016006133 T5 9/2018

*Primary Examiner* — Qin Zhu

(74) *Attorney, Agent, or Firm* — McGlew and Tuttle, P.C.

(57) ABSTRACT

An audio processing device (100) includes a correction microphone (110), a reference microphone (120), a classification unit (130), an active noise cancellation (ANC) unit (140), and a speaker (150). The correction microphone is arranged in an area adjacent to an ear of a user of the device and picks up acoustic signals in the area and outputs same as a correction signal. The reference microphone picks up surrounding noises (124) from a surrounding area of the user and outputs same as a reference signal. The classification unit receives the reference signal and splits the reference signal corresponding to a spectrum and amplitude thereof into signal components of two or more classes and outputs a classified signal. The ANC unit receives and processes the correction signal based on the classified signal and outputs a corresponding audio signal. The speaker receives the audio signal and provides a corresponding acoustic signal output.

20 Claims, 8 Drawing Sheets

(56) References Cited

U.S. PATENT DOCUMENTS

| | | | | |
|---|---|---|---|---|
| 2018/0336000 | A1* | 11/2018 | Vaughn | G06F 3/165 |
| 2019/0075879 | A1* | 3/2019 | Persson | G10K 11/17823 |
| 2019/0191237 | A1* | 6/2019 | Wang | G10K 11/17857 |

* cited by examiner

DEVICE, SYSTEM AND PROCESS FOR AUDIO SIGNAL PROCESSING

CROSS REFERENCE TO RELATED APPLICATIONS

This application claims the benefit of priority under 35 U.S.C. § 119 of German Application 10 2019 001 966.0, filed Mar. 21, 2019, the entire contents of which are incorporated herein by reference.

TECHNICAL FIELD

The present invention pertains to a device for noise-dependent audio signal processing and to a system for noise-dependent audio signal processing with the device for noise-dependent audio signal processing. The present invention further pertains to a process for noise-dependent audio signal processing.

TECHNICAL BACKGROUND

The communication of rescue teams plays a key role in the area of emergency services, especially in the work of firefighters. The areas, in which such a rescue operation is carried out, are, however, often exposed to high noise levels, for example, due to the surrounding noises of sirens, vehicles or ventilation systems. As a result, the necessary communication of rescue teams is made much more difficult.

Ensuring a voice communication by means of additional electrical communication equipment, for example, headphones or headset, especially in the area of firefighting operations is known. In this connection, the electrical communication equipment may be configured to receive signals from a microphone and to process these signals as a function of the noise level such that voice components within these signals are amplified and noise components are attenuated.

SUMMARY

An object of the present invention is to provide an improved audio signal processing for humans in a surrounding area exposed to noise, especially for firefighters during a rescue operation.

A device for noise-dependent audio signal processing with a correction microphone, a reference microphone, a classification unit, an active noise cancellation (ANC) unit and a first speaker is proposed according to a first aspect of the present invention to accomplish this object according to the present invention.

The correction microphone is arranged in an immediate vicinity of an area that is intended for an ear of a user of the device, adjacent to the ear of a user of the device, and is configured to pick up acoustic signals in the area intended for the ear and to forward (output) a correction signal based on the acoustic signals.

The reference microphone is arranged and configured to pick up surrounding noises from a surrounding area of the user of the device and to output a reference signal based on the surrounding noises. The correction microphone and the reference microphone are configured as two different microphones, which are oriented differently according to the present invention, wherein the correction microphone is oriented towards the area intended for the ear of the user of the device, and the reference microphone is oriented towards the surrounding area of the user of the device, pointing away from the user of the device.

The classification unit is configured to receive the reference signal and to split the reference signal, corresponding to its spectrum and its amplitude, into signal components of at least one first class and of at least one second class and to output a classified signal.

The ANC unit is configured to receive the correction signal, to process the correction signal based on the classified signal and to output a corresponding audio signal.

The first speaker is configured to receive the audio signal and to provide a corresponding acoustic signal output.

The present invention is based on the discovery that a pure processing of electronically transmitted communication signals, as is provided in prior-art communication systems, does not help in situations, in which a loud noise is heard directly next to a rescue team. Furthermore, it was discovered within the framework of the present invention that pure hearing protection gear may prevent a rescue team from perceiving important acoustic signals in a rescue team surrounding area such as, for example, voices of bystanders, vehicle noises or fire noises. The present invention accomplishes the set object based on this discovery by a combination of noise classification and subsequent processing as a function of the classification by an ANC unit.

Consequently, the signals pertinent to a rescue team can be advantageously classified such that they are not changed, amplified, or at least only slightly attenuated, whereas pure disturbing noises can be completely suppressed or at least slightly attenuated due to the active noise suppression achieved by means of the ANC unit. As a result, signals pertinent to the rescue team remain perceptible and yet a certain degree of hearing protection is guaranteed.

Furthermore, the simple integratability in existing communication devices is another advantage of the device according to the present invention. Signal processing can thus be carried out by suitable adaptation by existing communication devices, so that it is only necessary to implement the use of a reference microphone or of a number of reference microphones in such existing devices, which use can be embodied in a simple manner.

The device according to the present invention makes possible, moreover, advantageously different applications, since different classes, and especially different types of classes, are conceivable. In addition, different settings of the ANC unit may also be achieved according to the present invention. Hence, an individualized use of the device according to the present invention is also possible.

Another advantage of the device according to the present invention is that the general exposure to noise of a user of the device according to the present invention can be significantly reduced due to the processing of the correction signal by means of the ANC unit. Thus, one of the classes may comprise noises to be attenuated, which are perceived as highly attenuated by the user of the device according to the present invention due to an active noise suppression within the framework of the acoustic signal output.

The division into classification unit and ANC unit according to the present invention as different electrical components within the device may also be embodied as a functional division within a single processor, especially within a single electronic component.

The splitting into classes by the classification unit is based on a pattern recognition process, which analyzes the spectrum and amplitude of the reference signal received. Pattern recognition processes suitable for this are, in principle, known from other technical areas, for example, the use of neural networks or a support vector machine or a code book. A concrete implementation of such a pattern recognition process is, as was mentioned in the introduction, already known in the area of acoustic signal processing, so that a detailed description of this process will be dispensed with below.

The classified signal comprises a clear assignment of the signal components of the reference signal to the at least one first class and to the second class. Consequently, the ANC unit can process the corresponding signal components as a function of the assigned class.

The classified signal here may be a single signal which comprises the reference signal together with the current information about which signal components of which class are currently present. The classified signal may, however, be formed by a combination of signals as well. In particular, the classified signal may comprise the reference signal and at the same time an assignment signal which is synchronized in time with the reference signal and has the assignment to the class available for the current signal components.

The manner of functioning of the ANC unit in connection with active suppression of all surrounding noises is, in principle, known, so that this will not be explained in detail below.

The acoustic signals in the area intended for the ear typically also comprise the surrounding noises at least to some extent. The surrounding noises preferably do not or at least do not significantly comprise components of the acoustic signal output by the first speaker.

All of the acoustic phenomena from the surrounding area of the user of the device are defined as surrounding noises within the framework of this invention, i.e., especially also different types of acoustic signals or noises. A broad-band, acoustic phenomenon is typically designated as noise, whereas an acoustic signal typically designates a tonal, acoustic phenomenon with at least one defining spectral range. Such a distinction, which follows the conventions of the technical field, is not, however, defined as limiting within the framework of this invention. Acoustic phenomena, which typically represent noises, may also be designated below as signals or acoustic signals and vice versa.

Preferred embodiments of the device according to the present invention will be described below.

In an especially advantageous embodiment of the device according to the present invention, the device has, moreover, a signal amplifier which is configured to amplify the correction signal, the reference signal and/or the audio signal. A signal amplifier, which is configured to amplify the correction signal, advantageously makes possible an especially precise classification of the signal components of the reference signal by the classification unit. A signal amplifier, which is configured to amplify the audio signal, advantageously makes possible a specific amplification of the pertinent signal components, i.e., the signal components, which shall be outputted in an easily audible manner to the user of the device within the framework of the acoustic signal output. The signal amplifier forms a functional component of the device, which may also be configured in a common, electronic component with the ANC unit and/or with the classification unit.

In another advantageous embodiment, the classification unit is configured to output the reference signal in signal components of more than two classes. A plurality of classes advantageously make possible a specific control of a signal component output within the acoustic signal output of individual groups of signals and/or noises. Thus, voice components or vehicle noises within the reference signal can be processed differently than siren signals or fire noises. Furthermore, the use of a plurality of classes makes possible an especially individualized use of the device according to the present invention for different user groups.

In a preferred embodiment, the classes comprise at least one of the following groups of signals and/or noises: Siren signals, vehicle noises, voice signals, pump noises, ventilation noises, fire noises. The groups of signals and/or noises within the framework of this embodiment are especially advantageous for use within the framework of the work of firefighters. The classification unit is further configured in an especially advantageous variant of this embodiment to output the reference signal in signal components of more than two classes. Noises to be assigned to the different groups of signals and/or noises may be especially advantageously processed differently in this preferred variant. Thus, siren noises may be highly attenuated, whereas voice signals can be outputted in an amplified manner. Pump noises and ventilation noises, just as fire noises, usually form disturbing noises in case of the work of firefighters, so that the high muffling thereof within the framework of their active suppression by the ANC unit reduces the general exposure to noise during the rescue operation and improves communication via the specific amplification of voices.

In an especially preferred embodiment, the ANC unit is configured to determine the audio signal based on the classified signal such that the acoustic signal output based on the audio signal is suitable to interfere destructively with components of the surrounding noises which correspond to signal components of the reference signal from at least one class. The ANC unit makes possible an especially effective noise suppression within the framework of this embodiment.

In another embodiment of the device according to the present invention, the ANC unit is further configured to receive the reference signal and the correction signal, to process them based on the classified signal and to output a corresponding audio signal. Consequently, especially many pieces of signal information regarding the present surrounding noises are advantageously available to the ANC unit to provide a correspondingly suitable audio signal for active sound suppression by the first speaker. A variant, in which the ANC unit is further configured to receive the reference signal and the correction signal, to process them based on the classified signal and to output a corresponding audio signal, is, in principle, advantageous for all embodiments proposed below.

In another advantageous embodiment, the ANC unit is configured to assign a corresponding group of signals and/or noises to the classes of the classified signal and to process the correction signal, especially the correction signal and the reference signal based on the signal component of the classified signal, which signal component is assigned to at least one predefined group of signals and/or noises, such that the acoustic signal output based on the audio signal is suitable to interfere with components of the surrounding noises, which correspond to signal components of the reference signal from the at least one predefined group of signals and/or noises such that surrounding noises of this at least one predefined group of signals and/or noises are perceptible with a predefined amplitude in the area intended for the ear of the user of the device. Consequently, a predefined amplitude may advantageously be fixed for predefined groups of signals and/or noises. Thus, voice components within the reference signal may be amplified to the predefined amplitude regardless of their original amplitude, while siren signals are not completely suppressed for the sake of safety, but are only attenuated to a very low, predefined amplitude. A use of different predefined amplitudes for sounds from different predefined groups of signals and/or noises may advantageously correspond to the prioritization of certain signal components by the user of the device according to the present invention. Especially important signal components are amplified in this case, while disturbing surrounding noises are actively suppressed due to processing by means of the ANC unit.

In another embodiment of the device according to the present invention, the device further has a second speaker and an additional correction microphone, wherein the second speaker is configured to receive the audio signal or an additional audio signal and to provide a corresponding, additional, acoustic signal output. The additional correction microphone is arranged in an immediate vicinity of an area intended for another ear of the user of the device within the framework of this embodiment and is configured to pick up acoustic signals in the area intended for the other ear and to output an additional correction signal based on the picked up pick up acoustic signals. Within the framework of this embodiment, the ANC unit is further configured to receive the additional correction signal and to process the correction signal and the additional correction signal based on the classified signal. The ANC unit preferably outputs the audio signal and the additional audio signal in this embodiment. As a result, a directional dependence of the surrounding noises can be taken into consideration within the framework of the acoustic signals outputted by the two speakers. The ear and the other ear are defined as the left ear and the right ear of the user of the device within the framework of this embodiment. The audio signal, which is fed to the second speaker, can be distinguished from the audio signal, which is fed to the first speaker. In particular, in this embodiment, an advantageous, acoustic signal output according to the present invention may especially advantageously take place for both ears of the user of the device. In particular, the advantageous use of the device according to the present invention, within the framework of hearing protection, is especially effectively possible within the framework of this embodiment due to the use of two speakers and of two correction microphones.

In another especially preferred embodiment, the device has at least one additional reference microphone, which is arranged and configured to pick up surrounding noises from a surrounding area of the user of the device and to output an additional reference signal based on the picked up surrounding noises. The classification unit is configured within the framework of this embodiment to output the classified signal based on the reference signal and on the additional reference signal. Using a plurality of reference microphones within the framework of this embodiment makes possible an especially accurate detection of the surrounding noises and hence an especially efficient noise suppression within the framework of the acoustic signal output. The use of a plurality of reference microphones preferably makes possible a directional-dependent pickup and processing of the surrounding noises. The device has more than two reference microphones in an especially preferred variant of this embodiment. A relative position of the reference microphone and the additional reference microphone, or of a plurality of reference microphones, is predetermined in another variant of this embodiment. The processing of signals by the classification unit and/or by the ANC unit may be based on such a predetermined relative position between reference microphones.

A preprocessing unit is arranged between the correction microphone and the classification unit in one embodiment. The preprocessing unit is configured, for example, to amplify the correction signal. Moreover, the preprocessing unit is configured, for example, to filter out signal components outside of a predefined spectral range.

In another embodiment of the device, a residual processing unit is arranged between the ANC unit and the first speaker. The residual processing unit is configured, for example, to amplify the audio signal at least to some extent and to output an amplified audio signal to the first speaker. Moreover, the residual processing unit is configured in one embodiment to filter out signal components outside of a predefined spectral range.

In a preferred embodiment, the ANC unit is further configured to provide the audio signal and the additional audio signal. As a result, another audio signal may optionally be provided, for example, for a second speaker, wherein a position of the second speaker in relation to the first speaker can advantageously be taken into consideration. This may be advantageous, for example, for a device according to the present invention, which optionally makes possible, for example, a connection of the second speaker.

In another embodiment, the device further has a microphone holder, which connects the correction microphone and the first speaker permanently with one another such that a relative position of the correction microphone and the first speaker in relation to one another cannot be changed. In this embodiment, it is advantageously ensured that the correction microphone always receives an approximately equal share of the acoustic output of the audio signal predefined by its directional characteristic and a directional characteristic of the first speaker and further processes it according to the present invention. Consequently, the microphone holder advantageously makes possible a consistent quality of the signal processing by the device even in case of a movement or an intense physical stress of the device.

In one embodiment of the device according to the present invention, the device is integrated in a headset in accordance with at least one of the above embodiments. In this connection, one ear is preferably passively protected against noise, while the correction microphone is arranged at the other ear according to the present invention.

To accomplish the object according to the present invention, a system for noise-dependent audio signal processing is proposed according to a second aspect of the present invention, which system comprises a device in accordance with at least one of the above embodiments, as well as a gas mask and/or a helmet, wherein the first speaker is arranged such that the acoustic signal output takes place in an area intended for an ear of a user of the gas mask and/or of the helmet, and wherein the correction microphone is arranged in the immediate vicinity of the area intended for the ear.

The system according to the second aspect of the present invention combines the advantages of the audio signal processing according to the present invention in accordance with the first aspect of the present invention with the general advantages of a gas mask and/or of a helmet, for example, within the framework of the work of firefighters. Within the framework of the system according to the present invention, the device according to the first aspect of the present invention is especially advantageous, since the helmet and the gas mask usually lead to more difficult acoustic conditions and make it difficult to use conventional hearing protection measures.

The use of the system within the gas mask advantageously makes possible an especially simple integration of the device according to the present invention within a communication device intended for the gas mask.

According to the second aspect of the present invention, the first speaker can be arranged in the immediate vicinity of the area intended for the ear of the user. This can take place, for example, by an arrangement in the strap of the helmet, especially in the fabric of the strap of the helmet. This may take place, furthermore, by an arrangement on an inner side of the helmet, which inner side points towards the user of the helmet. A certain variability of an ear position within the helmet is preferably made possible due to the arrangement of the first speaker and hence allows the use of the system according to the present invention by different users with different head shapes. In an alternative or additional variant, the first speaker is arranged at a distance from the ear of the user of the helmet and/or of the gas mask, and is arranged at a resonance channel, so that the acoustic signal output reaches the ear of the user of the device according to the present invention via the resonance channel.

The reference microphone is arranged on an outer surface of the gas mask or of the helmet, which outer surface points away from a user of the gas mask and/or the helmet, in an especially preferred embodiment of the system according to the present invention. As a result, the surrounding noises as a whole can advantageously be picked up by the reference microphone. In an especially preferred variant of this embodiment, at least one additional reference microphone is arranged on the outer surface of the gas mask or of the helmet. This makes possible a direction-dependent processing of the respective reference signal by the classification unit and/or the ANC unit. In an advantageous example of this variant, the plurality of reference microphones are arranged at a fixed, predefined location in relation to one another. For example, the plurality of reference microphones are arranged in a helmet strap, which can be arranged on a lower helmet edge on a common helmet.

The classification unit and/or the ANC unit are arranged in an embodiment of the system according to the present invention in the vicinity of an area on the inner side of the helmet, which area is intended for the back of the head of the user of the system. As a result, the system according to the present invention can be provided at a helmet in an especially compact manner.

According to a third aspect of the present invention, the object according to the present invention is accomplished by a process for noise-dependent audio signal processing, having the steps

- picking up of acoustic signals in an area intended for an ear of a user of this process and forwarding (outputting) of a corresponding correction signal;
- picking up of noises surrounding a user of this process and forwarding (outputting) of a corresponding reference signal;
- receiving of the reference signal, splitting of the reference signal corresponding to its spectrum and its amplitude into signal components of at least one first class and at least one second class and outputting of a corresponding classified signal;
- receiving of the correction signal, processing of the correction signal based on the classified signal by a provided ANC unit and outputting of a corresponding audio signal; and
- receiving of the audio signal and provision of a corresponding acoustic signal output.

The process according to the present invention has the same process steps, which are carried out within the device according to the present invention. Hence, this process has the same advantages as the device according to the present invention.

The reference signal can be split into the at least two classes by an actual changing of the reference signal, for example, by adding class-related information. However, as an alternative or in addition, this splitting may also be achieved by the provision of an assignment signal synchronized in time with the reference signal, wherein the assignment signal indicates the class assigned to the signal component currently present in the reference signal.

In an embodiment of the process according to the present invention, the process further has the step of amplifying of the correction signal, of the reference signal and/or of the audio signal.

In another embodiment according to the present invention, the reference signal is split into more than two classes.

In one embodiment of the present invention, the process comprises an assigning of a predefined group of signals and/or noises to a corresponding class of the classified signal and processing of the correction signal based on the signal component of the classified signal, which signal component is assigned to at least one predefined group of signals and/or noises, by the ANC unit such that the acoustic signal output based on the audio signal is suitable to interfere with components of the surrounding noises, which correspond to signal components of the reference signal from the at least one predefined group of signals and/or noises such that surrounding noises of this at least one predefined group of signals and/or noises are perceptible with a predefined amplitude in the area that is intended for the ear of the user of this process.

In another embodiment of the present invention, the process further has the steps of

- picking up of other acoustic signals in an area intended for another ear of the user of this process and forwarding (outputting) of a corresponding additional correction signal;
- receiving of the additional correction signal and processing of the correction signal and of the additional correction signal based on the classified signal; and
- receiving of the audio signal and provision of an additional acoustic signal output at the other ear of the user of this process.

In another embodiment of the present invention, the process further has the steps of

- picking up of other noises surrounding a user of this process and forwarding (outputting) of a corresponding additional reference signal; and
- outputting of the classified signal based on the reference signal and on the additional reference signal.

The present invention shall now be explained in more detail on the basis of advantageous exemplary embodiments, which are schematically shown in the figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
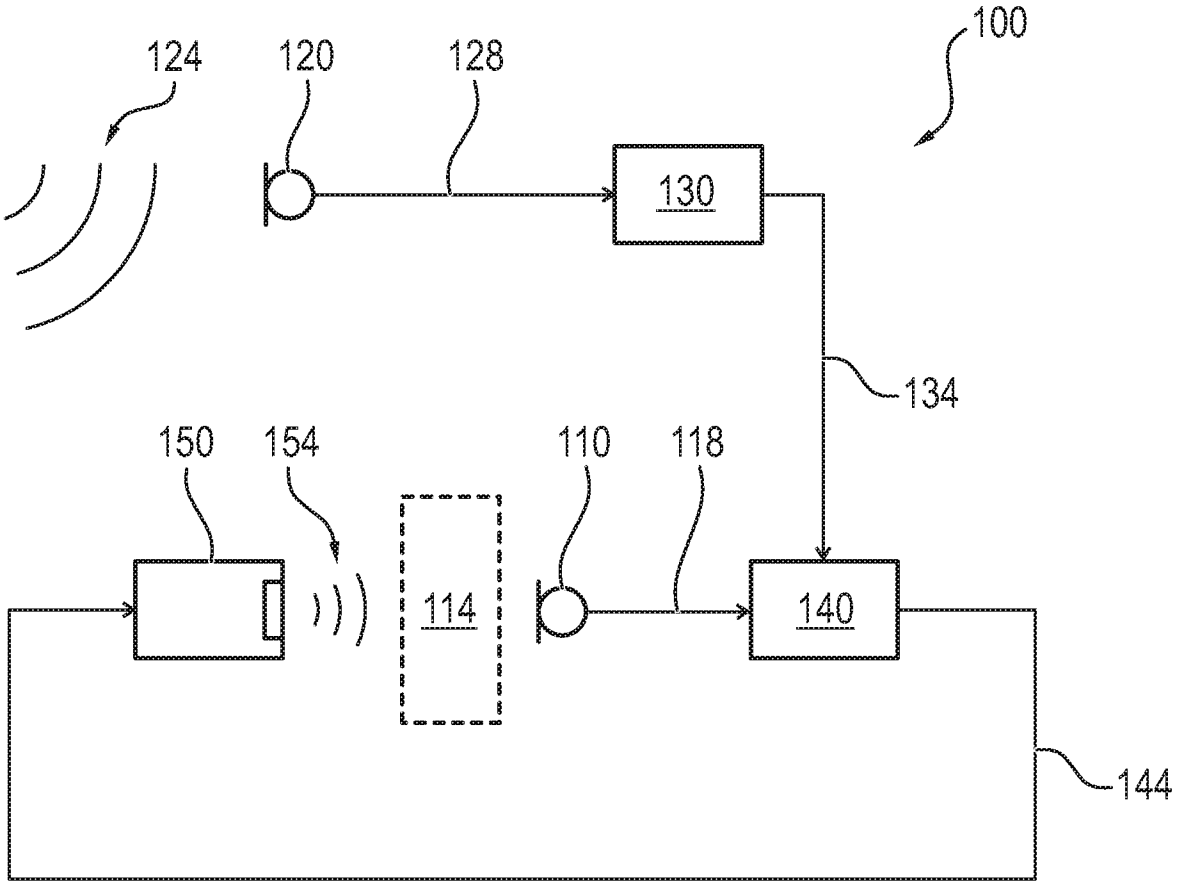
FIG. 1 is a schematic view of a configuration of a device according to a first exemplary embodiment of the first aspect of the present invention.

Referring to the drawings, FIG. 1 shows a schematic configuration of a device 100 according to a first exemplary embodiment of the first aspect of the present invention.

The device 100 for noise-dependent audio signal processing comprises a correction microphone 110, a reference microphone 120, a classification unit 130, an ANC unit 140 and a first speaker 150.

The correction microphone 110 is arranged in an immediate vicinity of an area 114 intended for an ear of a user of the device. The correction microphone 110 is configured to pick up acoustic signals in the area 114 intended for the ear and to forward (output) them as a correction signal 118. The correction microphone 110 is oriented in this case towards the area 114 intended for the ear.

The reference microphone 120 is arranged and configured to pick up surrounding noises 124 from a surrounding area of the user of the device 100 and to forward (output) them as a reference signal 128. The reference microphone 120 is oriented in this case towards the surrounding area of the user of the device 100. The directions, in which the correction microphone 110 and the reference microphone 120 are each oriented, preferably differ here.

The classification unit 130 is configured to receive the reference signal 128 and to split the reference signal 128 corresponding to a reference signal spectrum and a reference signal amplitude into signal components of at least one first class and at least one second class and to output a classified signal 134. In this embodiment, the splitting into the first and second class is based on a signal processing of the reference signal 128 by a support vector machine applied to the spectrum and amplitude of the reference signal 128. As an alternative or in addition, in another exemplary embodiment, not shown, another prior-art pattern recognition process is used, for example, based on neural networks and/or on a code book.

The ANC unit 140 is configured to receive the correction signal 118, to process it based on the classified signal 134 and to output it as an audio signal 144.

The first speaker 150 is configured to receive the audio signal 144 and to provide a corresponding acoustic signal output 154. In the present exemplary embodiment, the first speaker 150 is arranged in the immediate vicinity of the area 114 intended for the ear. Furthermore, the first speaker 150 is oriented towards this area 114. In the present embodiment, the correction microphone 110 and the first speaker 150 are arranged at a distance from one another, namely in different edge areas of the area 114 intended for the ear. As a result, the correction microphone 110 is prevented from only picking up the acoustic signal output 154 of the first speaker 150 as acoustic signals and forwarding (outputting) them as a correction signal 118. Thus, it is made possible for the correction microphone 110 to also pick up surrounding noises 14 in addition to the acoustic signal output 154 as acoustic signals and to forward (output) them as a correction signal 118. The correction microphone 110 and the first speaker 150 are arranged adjacent to one another in another alternative exemplary embodiment.

An active noise reduction, used as active noise suppression in the present embodiment, which is made possible by the ANC unit 140, is achieved in this exemplary embodiment by the ANC unit 140 being configured to determine the audio signal 144 based on the classified signal 134 such that the acoustic signal output 154 corresponding to the audio signal 144 interferes destructively at least with components of the surrounding noises 124. The components of the surrounding noises 124, with which the acoustic signal output 154 interferes destructively and differs, correspond here to the signal components of the reference signal 128 from at least one class.

The device 100 according to the exemplary embodiment being shown is configured such that the classification unit 130 and the ANC unit 140 are configured as electronic components which are separated from one another. The classification unit and the ANC unit are configured as components of a single signal processing unit of the device in an alternative exemplary embodiment according to the present invention, not shown.

Figure 2:
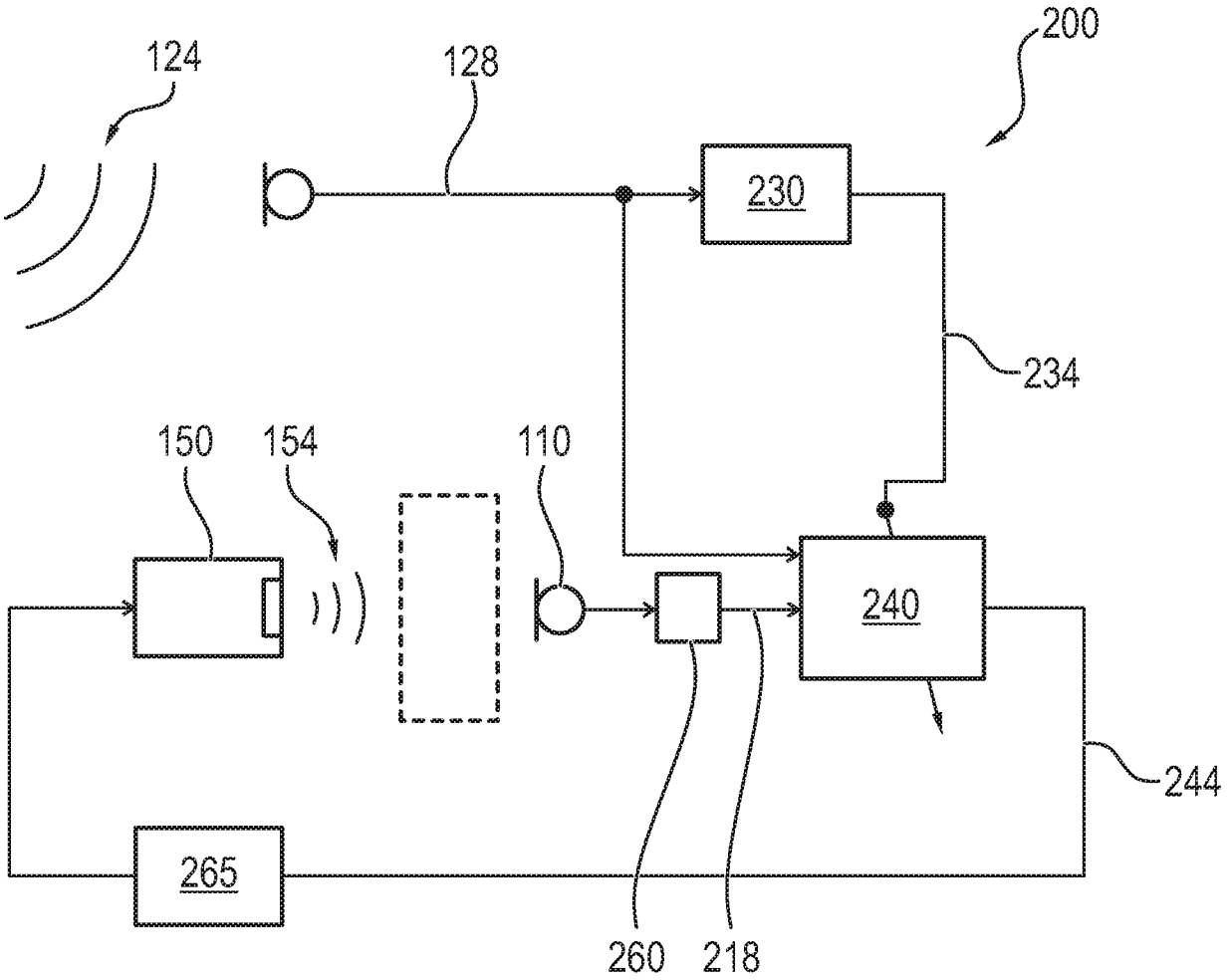
FIG. 2 is a schematic view of a configuration of a device according to a second exemplary embodiment of the first aspect of the present invention.

FIG. 2 shows a schematic configuration of a device 200 according to a second exemplary embodiment of the first aspect of the present invention.

The device 200 differs from the device 100 shown in FIG. 1 by the features described below.

The ANC unit 240 of the device 200 is further configured to receive the reference signal 128 and the correction signal 218 and to process them based on the classified signal 234. As a result, many pieces of signal information, especially related to the surrounding noises 124, can advantageously especially be taken into consideration during the processing by the ANC unit 240. The classified signal 234 in this exemplary embodiment is a signal synchronized in real time with the reference signal 128, which indicates the class currently assigned to the signal component of the reference signal 128. As a result, the classified signal 234 in this exemplary embodiment is a pure control variable for the ANC unit 240.

By contrast to the correction signal 118 from FIG. 1, the correction signal 218 is generated by processing using the signal of the correction microphone 110 and subsequent frequency band correction by a filter unit 260. The correction signal 218 is hence a processed correction signal 218.

Furthermore, the device 200 additionally comprises a signal amplifier 265, which is configured to amplify a provided audio signal 244, before it is received by the first speaker 150.

In an exemplary embodiment, not shown, an alternative or additional signal amplifier is configured to amplify the reference signal and/or the correction signal.

In another exemplary embodiment, not shown, the filter unit is configured to function as a high-pass filter and/or as a low-pass filter. As a result, spectral components that are irrelevant for the acoustic output can be filtered out already before an unnecessary further processing.

The classification unit 230 of the device 200 is further configured to output the reference signal 128 in signal components of more than two classes. In this case, the classification unit 230 is configured to take into consideration classes of the following groups of signals and/or noises: Siren signals, vehicle noises, voice signals, pump noises, ventilation noises, and fire noises. In other exemplary embodiments, the classes comprise at least one of the specified groups of signals and/or noises. Based on a classification carried out by the classification unit 230 in this manner, the ANC unit 240 is configured to provide the audio signal 244 such that the acoustic signal output 154 by the first speaker 150 interferes with the acoustic signals in the area intended for the ear such that surrounding noises of a particular predefined group of signals and/or noises are perceptible with a corresponding predefined amplitude in the area intended for the ear of the user of the device 200. As a result, it is achieved in the present embodiment that speech can be perceived in a volume that makes possible a communication with bystanders. Furthermore, typical disturbing noises, such as pump noises, ventilation noises and fire noises are extensively suppressed, while siren signals and vehicle noises are kept at a medium volume, in order to keep the exposure to noise of the user of the device 200 within a framework that is not harmful to health.

Figure 3:
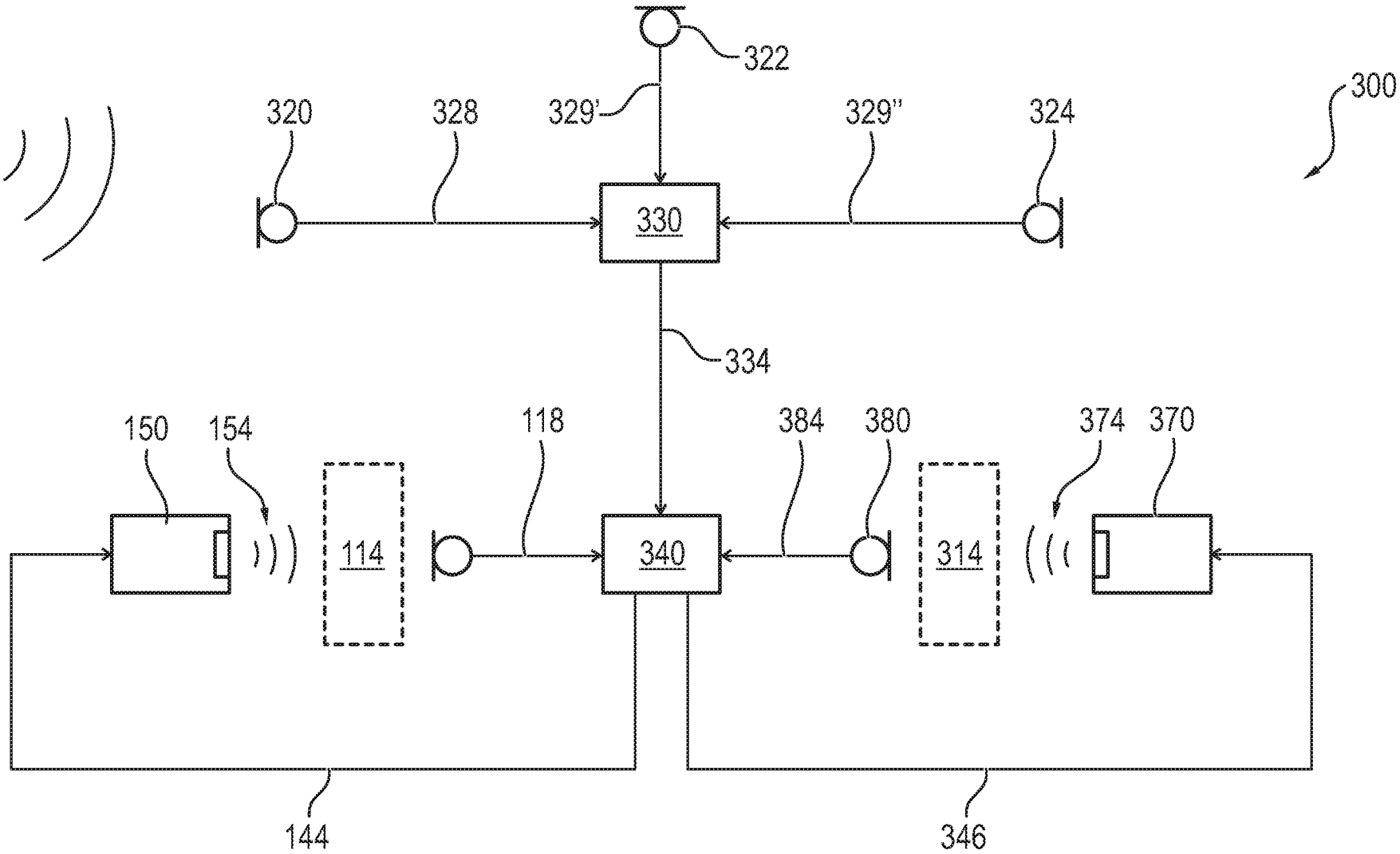
FIG. 3 is a schematic view of a configuration of a device according to a third exemplary embodiment of the first aspect of the present invention.

FIG. 3 shows a schematic configuration of a device 300 according to a third exemplary embodiment of the first aspect of the present invention.

The device 300 according to the present invention differs from the devices 100 and 200 by the features described below.

The device 300 comprises, in addition to the reference microphone 320, two additional reference microphones 322, 324. These three reference microphones are oriented in three different directions in relation to the user of the device 300. Furthermore, the reference microphones are configured to pick up and to forward (output) surrounding noises from the surrounding area of the user of the device. In this case, the reference microphone 320 forwards (outputs) the reference signal 328 and the additional reference microphones 322, 324 forward (output) a respective additional reference signal 329', 329". The classification unit 330 according to the present invention is configured here to output the classified signal 334 based on the reference signal 328 and on the two additional reference signals 329', 329".

Moreover, the device 300 comprises a second speaker 370 and an additional correction microphone 380. The second speaker 370 is configured to receive an additional audio signal 346 outputted by the ANC unit 340 and to provide a corresponding, additional, acoustic signal output 374. In an exemplary embodiment, not shown, the additional audio signal corresponds to the audio signal. The additional correction microphone 380 is arranged in an immediate vicinity of an area 314 intended for another ear of the user of the device 300 and is configured to pick up acoustic signals in the area 314 intended for the other ear and to forward (output) them as an additional correction signal 384.

The ANC unit 340 is configured here to receive the additional correction signal 384 and to process the correction signal 118 and the additional correction signal 384 based on the classified signal 334. As a result of this processing, the audio signal 144 and the additional audio signal 346 are outputted. The audio signal 144 and the additional audio signal 346 are configured here such that the active noise suppression in the respective area 114, 314 intended for an ear of the user of the device 300 is dependent on the position of this respective area in relation to a noise direction of a signal or noise belonging to a suppressed class. In this connection, the noise direction is determined by a known orientation of the three reference microphones 320, 322, 324. In an exemplary embodiment, not shown, the same audio signal is sent to the speakers 150 and 380.

Figure 4:
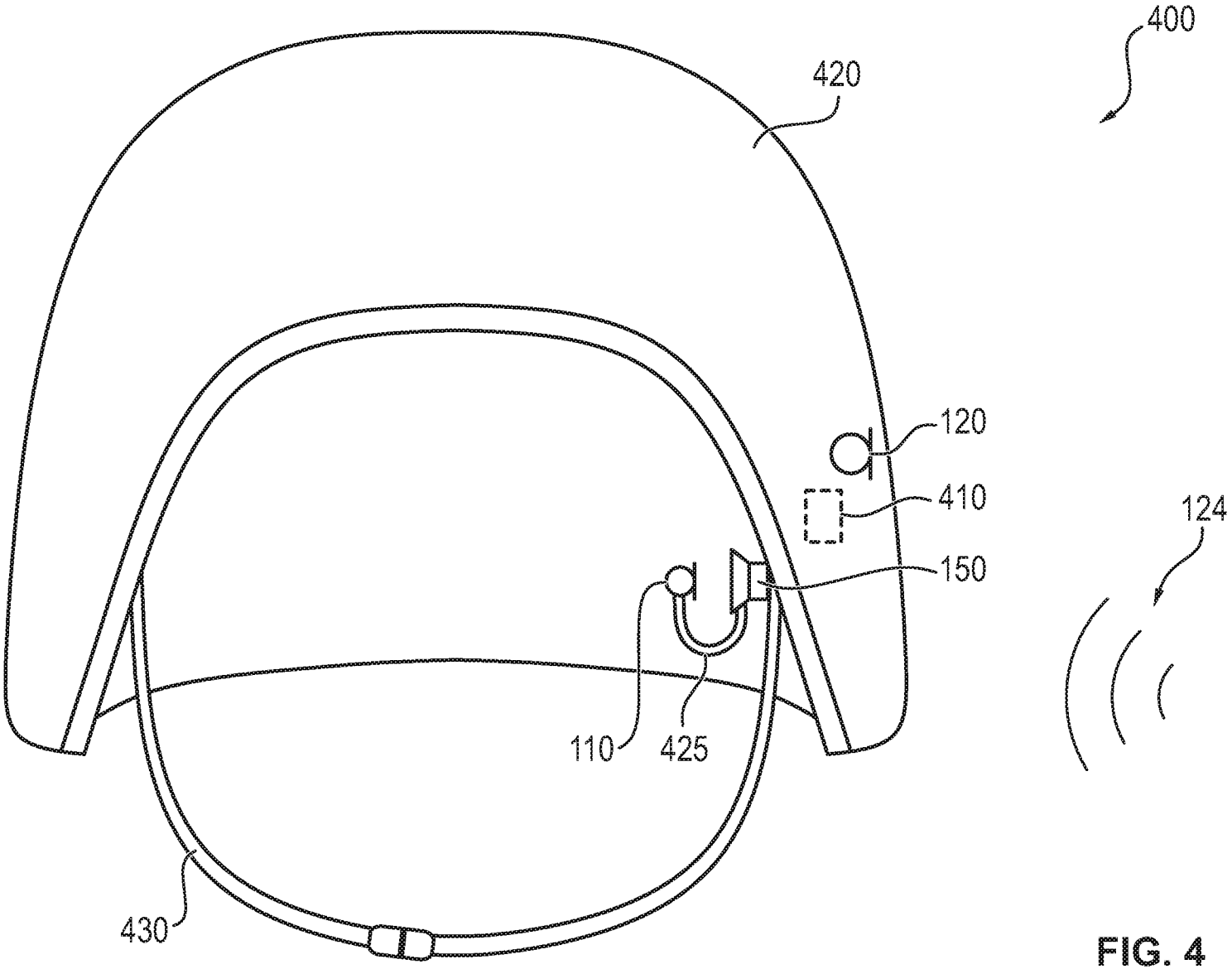
FIG. 4 is a perspective view of a system according to a first exemplary embodiment of the second aspect of the present invention.

FIG. 4 shows a perspective view of a system 400 according to a first exemplary embodiment of the second aspect of the present invention.

The system 400 according to the present invention comprises the device 100 shown in FIG. 1, with the only difference being that the classification unit and the ANC unit are embodied in a common signal processing unit 410. The manner of functioning of all the components takes place as described within the framework of FIG. 1.

Furthermore, the system 400 according to the present invention comprises a helmet 420, wherein the first speaker 150 is arranged such that the acoustic signal output takes place in the area intended for the ear (configured for receiving the ear) of a user of the helmet 420. Furthermore, the correction microphone 110 is arranged in the immediate vicinity of the area intended for the ear. In this case, the correction microphone 110 is fastened to the first speaker 150 via a microphone holder 425, as a result of which a predefined relative position of the correction microphone 110 and the first speaker 150 can also be maintained in case of a movement of the system 400 or under the effect of a physical stress.

In the exemplary embodiment shown, the correction microphone 110 and the first speaker 150 are arranged in the fabric of a strap 430 of the helmet 420.

The reference microphone 120 is arranged on an outer side of the helmet 420. In this case, the reference microphone 120 is oriented towards a direction pointing away from the user of the system 400. As a result, it is advantageously ensured that the surrounding noises 124 picked up by the reference microphone 120 are not formed by the acoustic signal output from the first speaker 150 to a significant extent.

In order to ensure protection against noise, a user of the system 400 would use a prior-art passive hearing protector in the ear that is not located at the correction microphone 110.

In one exemplary embodiment, not shown, the first speaker of the system is not arranged in an immediate vicinity of the area intended for the ear but rather in another area of the helmet, wherein the acoustic signal output is sent via a resonance space to the user of the system, especially to at least one ear of the user of the system.

Figure 5:
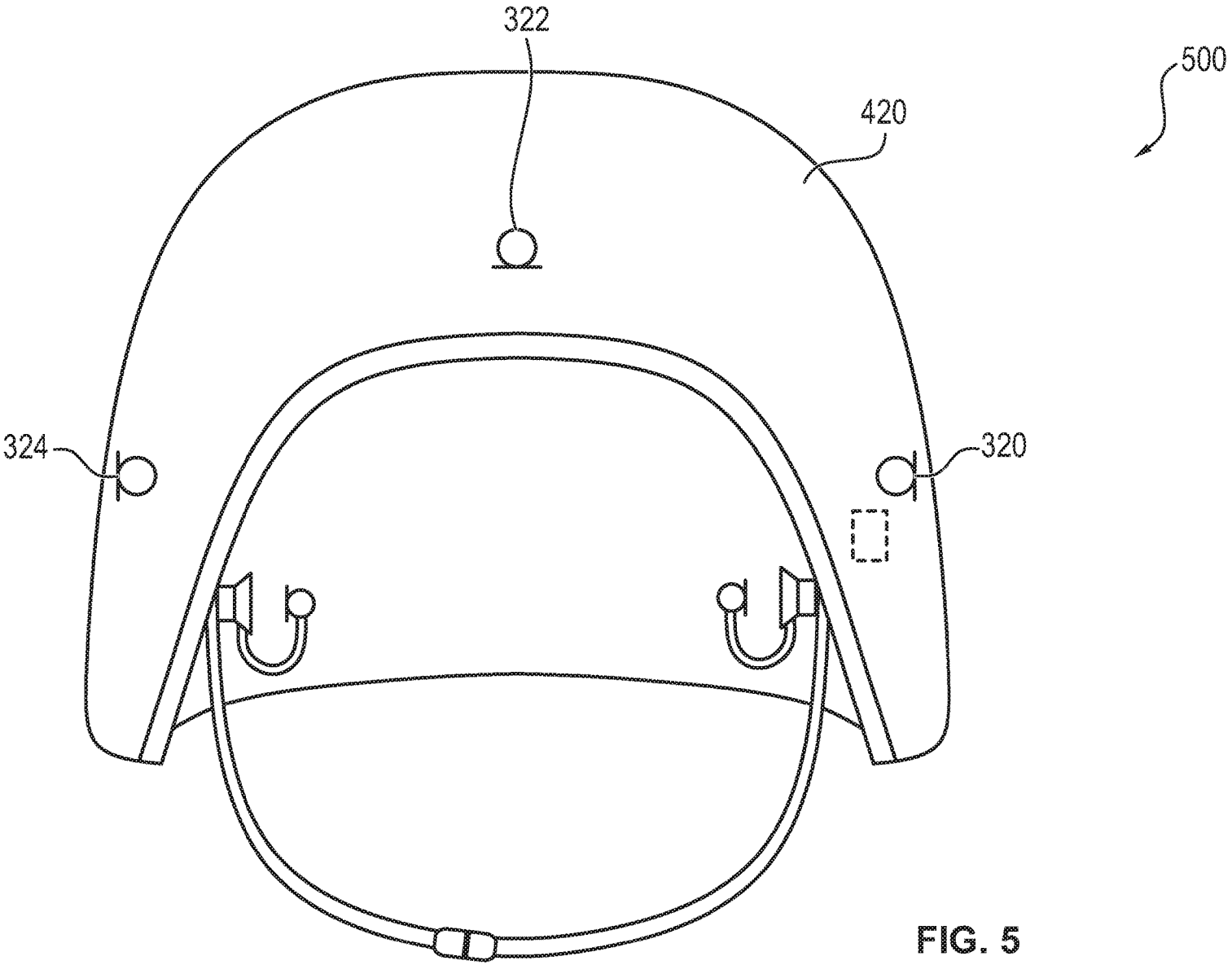
FIG. 5 is a perspective view of a system according to a second exemplary embodiment of the second aspect of the present invention.

FIG. 5 shows a perspective view of a system 500 according to a second exemplary embodiment of the second aspect of the present invention.

By contrast to the system 400 shown in FIG. 4, the system 500 comprises the device 300 shown in FIG. 3.

The classification unit and the ANC unit are arranged here in a housing, not shown, in an area of the helmet, which area is located on the rear inside from the viewpoint of the user.

The reference microphones 320, 322, 324 are arranged in different positions on an outer side of the helmet 420 such that they are oriented in different directions. As a result, surrounding noises can be especially easily picked up from different directions.

In one exemplary embodiment of the system according to the present invention, which is not shown, a plurality of reference microphones are arranged on a helmet strap, which can be arranged on a lower edge of a helmet, especially of a half-shell helmet. As a result, the system according to the present invention can advantageously be arranged on existing helmets in an especially simple manner.

Figure 6:
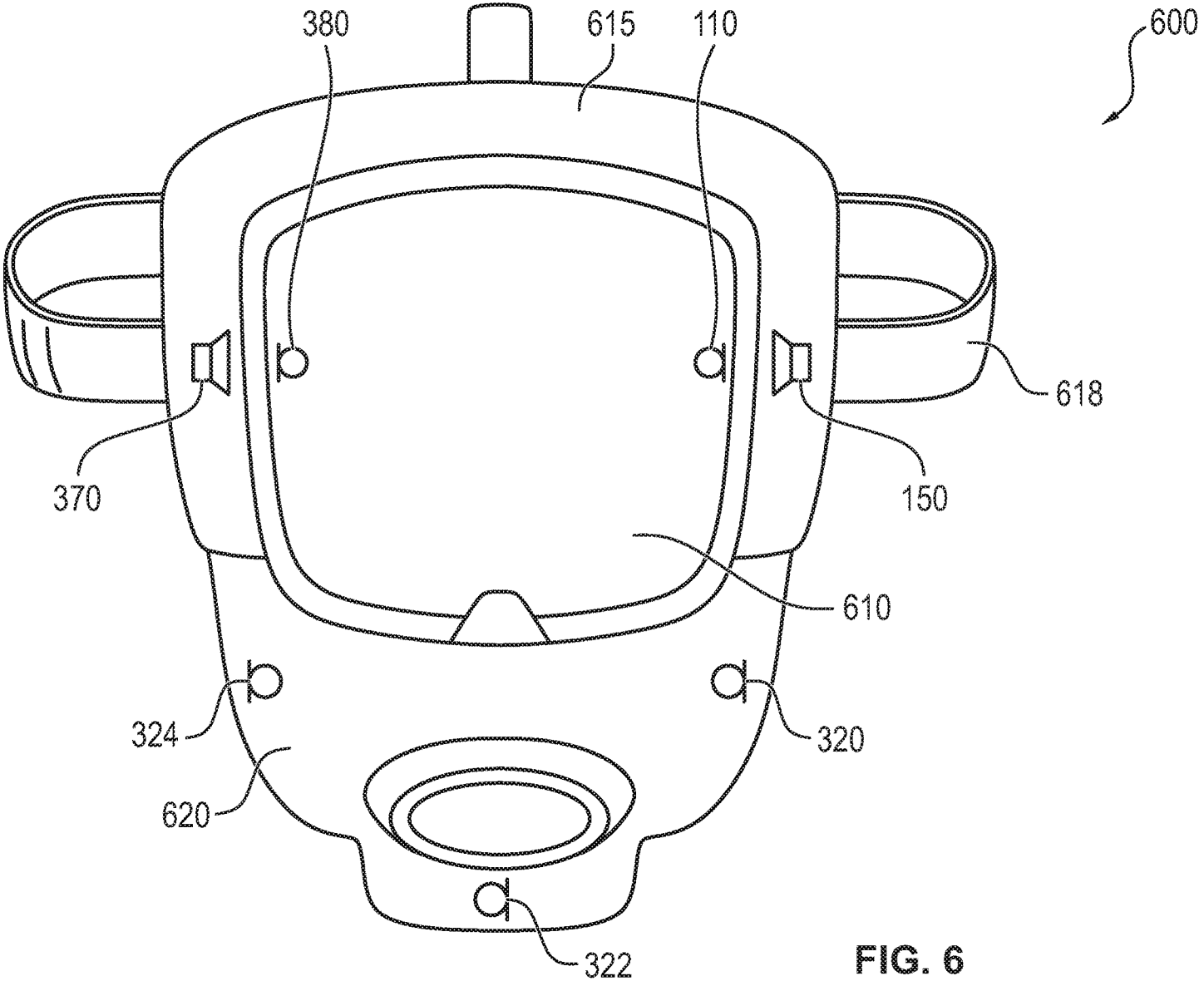
FIG. 6 is a perspective view of a system according to a third exemplary embodiment of the second aspect of the present invention.

FIG. 6 shows a perspective view of a system 600 according to a third exemplary embodiment of the second aspect of the present invention.

The system 600 according to the present invention has the device shown in FIG. 3, as well as a gas mask 610, wherein the first speaker 150 and the second speaker 370 are arranged on a mask body 615 or on a strap 618 of the gas mask 610 such that the acoustic signal output and the additional acoustic signal output take place each in an area intended for the ear of the user of the gas mask. The correction microphone 110 and the additional correction microphone 380 are each arranged in the immediate vicinity to this area. In this case, the correction microphone 110 and the additional correction microphone 380 are arranged at a respective housing of the first speaker and of the second speaker 150, 370, taking the directional characteristic of the microphones 110, 380 into consideration. The two microphones 110, 380 are advantageously omnidirectional microphones in the exemplary embodiment shown. Microphones with different directional characteristics are used in exemplary embodiments, not shown.

The three reference microphones 320, 322, 324 are integrated in a connection piece 620 of the gas mask 610 for the connection of a gas filter or of a compressed air breathing apparatus.

Within a gas mask, the device according to the present invention can especially advantageously be integrated into existing electronic devices of prior-art communication systems for gas masks.

Figure 7:
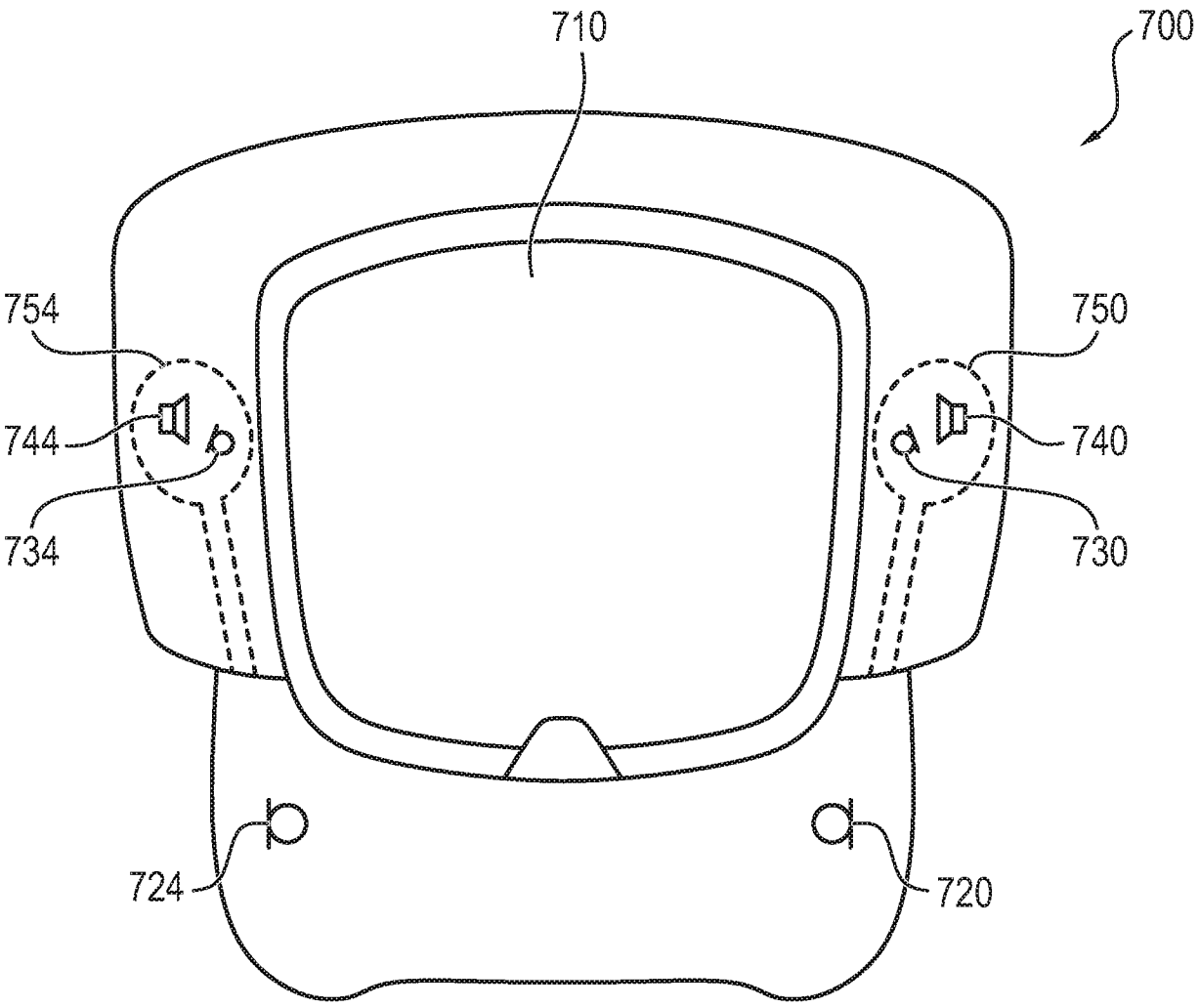
FIG. 7 is a perspective view of a system according to a fourth exemplary embodiment of the second aspect of the present invention.

FIG. 7 shows a perspective view of a system 700 according to a fourth exemplary embodiment of the second aspect of the present invention.

The system 700 according to the present invention comprises a gas mask 710, similar to the system 600 shown in FIG. 6. A device according to the present invention integrated in it comprises two reference microphones 720, 724, which are arranged on an outer side of the gas mask 720 pointing in different directions. The correction microphone 730 and the additional correction microphone 734 are integrated together with the first speaker and the second speaker 740, 744 in a respective separate ear part 750, 754, which is each fastened to the gas mask 710. The correction microphone 730 and the additional correction microphone 734 are in this case oriented towards the respective speaker 740, 744.

The system 700 according to the present invention especially advantageously makes it possible to individually adapt the position of the correction microphone and the speaker to a present individual head shape of the user of the gas mask due to the movable separate ear parts 750, 754.

Figure 8:
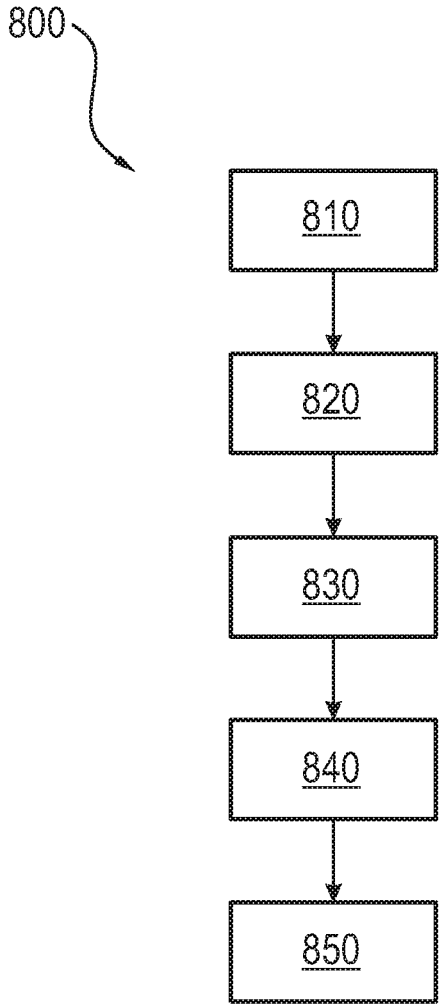
FIG. 8 is a block diagram of a process according to an exemplary embodiment of the third aspect of the present invention.

FIG. 8 shows a block diagram of a process 800 according to an exemplary embodiment of the third aspect of the present invention.

The process 800 according to the present invention for noise-dependent audio signal processing has in this case the following steps in chronological order.

A first step 810 comprises the picking up of acoustic signals in an area intended for an ear of a user of this process and the forwarding (outputting) of a corresponding correction signal.

A next step 820 comprises the picking up of noises surrounding a user of this process and the forwarding (outputting) of a corresponding reference signal.

A next step 830 comprises the receiving of the reference signal, the splitting of the reference signal corresponding to its spectrum and its amplitude into signal components of at least one first class and at least one second class and the outputting of a corresponding classified signal.

A next step 840 comprises the receiving of the correction signal, the processing of the correction signal based on the classified signal by a provided ANC unit and the outputting of a corresponding audio signal.

A last step 850 comprises the receiving of the audio signal and the provision of a corresponding acoustic signal output.

The process 800 according to the present invention is repeated in fast chronological order, wherein the steps can be carried out at the same time or almost at the same time. Thus, the active noise suppression by the provided ANC unit is based on the fact that the acoustic signal output is constantly adapted to a current surrounding noise in order to ensure thereby the desired partially destructive interference between the acoustic signal output and the current surrounding noises.

While specific embodiments of the invention have been shown and described in detail to illustrate the application of the principles of the invention, it will be understood that the invention may be embodied otherwise without departing from such principles.

LIST OF REFERENCE NUMBERS

100, 200, 300 Device according to the present invention
110, 730 Correction microphone
114, 314 Area intended for the ear of a user
118 Correction signal
120, 320, 720 Reference microphone
124 Surrounding noises
128, 328 Reference signal
130, 230, 330 Classification unit
134, 234 Classified signal
140, 240, 340 ANC unit
144, 244 Audio signal
150, 740 First speaker
154 Acoustic signal output
218 Processed correction signal
260 Filter unit
265 Signal amplifier
322, 324, 724 Additional reference microphone
329', 329" Additional reference signal
346 Additional audio signal
370, 744 Second speaker
374 Additional acoustic signal output
380, 734 Additional correction microphone
384 Additional correction signal
400, 500, 600, 700 System according to the present invention
410 Common signal processing unit
420 Helmet
425 Microphone holder
430 Strap of the helmet
610, 710 Gas mask
615 Mask body
618 Strap of the gas mask
620 Connection piece
750 First ear part
754 Second ear part
800 Process according to the present invention
810, 820, 830, 840, 850 Process steps

What is claimed is:

1. A device for noise-dependent audio signal processing, the device comprising:

a correction microphone arranged in an immediate vicinity of an area intended for an ear of a user of the device, the correction microphone being configured to pick up acoustic signals in the area intended for the ear and to output a correction signal corresponding to the picked up acoustic signals;

a reference microphone arranged and configured to pick up surrounding noises from a surrounding area of the user of the device and to output a reference signal corresponding to the pick up surrounding noises;

a classification unit configured to receive the reference signal and to split the reference signal corresponding to a reference signal spectrum of the reference signal and a reference signal amplitude of the reference signal into signal components of the reference signal of more than two classes and to output a classified signal based on the signal components of the reference signal of more than two classes, wherein the classes comprise at least one of the following groups of signals and/or noises: siren signals, vehicle noises, voice signals, pump noises, ventilation noises, fire noises;

an active noise cancellation unit configured to receive the correction signal to process the correction signal based on the classified signal and to output a corresponding audio signal; and a speaker configured to receive the audio signal and to provide a corresponding acoustic signal output.

2. A device in accordance with claim 1, further comprising a signal amplifier configured to amplify the correction signal, or the reference signal or the audio signal or any combination of the correction signal, the reference signal and the audio signal.

3. A device in accordance with claim 1, wherein the active noise cancellation unit is configured to determine the audio signal based on the classified signal such that the acoustic signal output based on the audio signal is suitable to interfere destructively with components of the surrounding noises which correspond to signal components of the reference signal from at least one class.

4. A device in accordance with claim 1, wherein the active noise cancellation unit is configured to assign a corresponding group of signals and/or noises to the classes of the classified signal and to process the correction signal based on the signal component of the classified signal, which signal component is assigned to at least one predefined group of signals and/or noises, such that the acoustic signal output based on the audio signal is suitable to interfere with components of the surrounding noises, which correspond to signal components of the reference signal from the at least one predefined group of signals and/or noises such that surrounding noises of this at least one predefined group of signals and/or noises are perceptible with a predefined amplitude in the area intended for the ear of the user of the device.

5. A device in accordance with claim 1, further comprising:

an additional speaker; and an additional correction microphone, wherein:

the additional speaker is configured to receive the audio signal or an additional audio signal output from the active noise cancellation unit and to provide a corresponding, additional, acoustic signal output;

the additional correction microphone is arranged in an immediate vicinity of an area intended for another ear of the user of the device and is configured to pick up acoustic signals in an area intended for the other ear and to output an additional correction signal based on the picked up acoustic signals; and the active noise cancellation unit is further configured to receive the additional correction signal and to process the correction signal and the additional correction signal based on the classified signal.

6. A device in accordance with claim 1, further comprising at least one additional reference microphone, which is arranged and configured to pick up surrounding noises from a surrounding area of the user of the device and to output them as an additional reference signal based on the pick up surrounding noises, wherein the classification unit is configured to output the classified signal based on the reference signal and on the additional reference signal.

7. A device in accordance with claim 1, further comprising, a microphone holder connecting the correction microphone and the speaker to fix a relative position of the correction microphone and the speaker in relation to one another.

8. A system for noise-dependent audio signal processing, the system comprising:

a gas mask or a helmet or a helmet and gas mask, the gas mask or the helmet or the helmet and gas mask having an area intended for an ear of a user of the gas mask; and a device for noise-dependent audio signal processing, the device comprising:

a correction microphone arranged in an immediate vicinity of the area intended for an ear of a user of the device, the correction microphone being configured to pick up acoustic signals in the area intended for the ear and to output a correction signal corresponding to the picked up acoustic signals;

a reference microphone arranged and configured to pick up surrounding noises from a surrounding area of the gas mask or the helmet or the helmet and gas mask and to output a reference signal corresponding to the pick up surrounding noises;

a classification unit configured to receive the reference signal and to split the reference signal corresponding to a reference signal spectrum of the reference signal and a reference signal amplitude of the reference signal into signal components of at least one first class and at least one second class and to output a classified signal;

an active noise cancellation unit configured to receive the correction signal to process the correction signal based on the classified signal and to output a corresponding audio signal;

a speaker configured to receive the audio signal and to provide a corresponding acoustic signal output in the area intended for an ear of a user of the gas mask, wherein the classification unit is configured to output the reference signal in signal components of more than two classes; and the classes comprise at least one of the following groups of signals and/or noises: siren signals, vehicle noises, voice signals, pump noises, ventilation noises, fire noises.

9. A system in accordance with claim 8, wherein the reference microphone is arranged on an outer surface of the gas mask or of the helmet or the helmet and gas mask, which outer surface points away from a user of the gas mask or the helmet or the helmet and gas mask.

10. A process for noise-dependent audio signal processing, the process comprising the steps of:

picking up of acoustic signals in an area intended for an ear of a user of this process and forwarding a corresponding correction signal;

picking up of noises surrounding a user and forwarding a corresponding reference signal;

receiving the reference signal and splitting the reference signal corresponding to a reference signal spectrum and a reference signal amplitude into signal components of at least one first class and at least one second class and outputting of a corresponding classified signal;

receiving the correction signal and processing the correction signal, based on the classified signal, by a provided active noise cancellation unit and outputting a corresponding audio signal from the provided active noise cancellation unit; and receiving of the audio signal and providing a corresponding acoustic signal output.

11. A process in accordance with claim 10, further comprising the step of:

amplifying the correction signal, or amplifying the reference signal; or amplifying the audio signal; or amplifying one or more of the correction signal and the reference signal and the audio signal.

12. A process in accordance with claim 10, further comprising the steps of assigning a predefined group of signals and/or noises to a corresponding class of the classified signal;

processing the correction signal based on the signal component of the classified signal, which signal component is assigned to at least one predefined group of signals and/or noises, by the active noise cancellation unit such that the acoustic signal output based on the audio signal is suitable to interfere with components of the surrounding noises, which correspond to signal components of the reference signal from the at least one predefined group of signals and/or noises such that surrounding noises of the at least one predefined group of signals and/or noises are perceptible with a predefined amplitude in the area that is intended for the ear of the user of this process.

13. A process in accordance with claim 10, further comprising the steps of:

picking up of other acoustic signals in an area intended for another ear of the user and forwarding a corresponding additional correction signal;

receiving the additional correction signal and processing of the correction signal and of the additional correction signal based on the classified signal; and receiving the audio signal and providing an additional acoustic signal output in the area intended for the other ear of the user of this process.

14. A process in accordance with claim 10, the process further comprising the steps of:

picking up of other noises surrounding a user and forwarding a corresponding additional reference signal; and outputting the classified signal based on the reference signal and based on the additional reference signal.

15. A process in accordance with claim 10, further comprising:

providing a classification unit, the reference signal being provided directly to the classification unit, the classification unit providing the classified signal as output directly to the active cancellation unit.

16. A process in accordance with claim 15, further comprising:

providing a reference microphone providing the reference signal as output, wherein the reference microphone, the classification unit and the active noise cancellation unit define at least a portion of a sound transmission path, wherein the classification unit is located between the reference microphone and the active noise cancellation unit along the sound transmission path.

17. A system in accordance with claim 8, wherein the classification unit is configured to receive the reference signal directly from the reference microphone and the active cancellation unit is configured to receive the classified signal directly from the classification unit.

18. A system in accordance with claim 8, wherein the reference microphone, the classification unit and the active noise cancellation unit define at least a portion of a sound transmission path, wherein the classification unit is located between the reference microphone and the active noise cancellation unit along the sound transmission path.

19. A device in accordance with claim 1, wherein the classification unit is configured to receive the reference signal directly from the reference microphone and the active cancellation unit is configured to receive the classified signal directly from classification unit.

20. A device in accordance with claim 1, wherein the reference microphone, the classification unit and the active noise cancellation unit define at least a portion of a sound transmission path, wherein the classification unit is located between the reference microphone and the active noise cancellation unit along the sound transmission path.

* * * * *